US011508273B2

(12) United States Patent
Orio et al.

(10) Patent No.: US 11,508,273 B2
(45) Date of Patent: Nov. 22, 2022

(54) BUILT-IN TEST OF A DISPLAY DRIVER

(71) Applicant: Synaptics Incorporated, San Jose, CA (US)

(72) Inventors: Masao Orio, Tokyo (JP); Takashi Nose, Kanagawa (JP); Hirobumi Furihata, Tokyo (JP); Akio Sugiyama, Tokyo (JP); Kota Kitamura, Tokyo (JP); Chirinjeev Singh, San Jose, CA (US); Dipankar Talukdar, San Jose, CA (US); Guozhong Shen, Fremont, CA (US)

(73) Assignee: Synaptics Incorporated, San Jose, CA (US)

( * ) Notice: Subject to any disclaimer, the term of this patent is extended or adjusted under 35 U.S.C. 154(b) by 0 days.

(21) Appl. No.: 17/096,726

(22) Filed: Nov. 12, 2020

(65) Prior Publication Data

US 2022/0148470 A1 May 12, 2022

(51) Int. Cl.
*G09G 3/3275* (2016.01)
*G09G 3/00* (2006.01)

(52) U.S. Cl.
CPC ..... *G09G 3/006* (2013.01); *G09G 2320/0673* (2013.01); *G09G 2330/12* (2013.01)

(58) Field of Classification Search
CPC ..... G09G 3/006; G09G 2320/0673; G09G 2330/12
See application file for complete search history.

(56) References Cited

U.S. PATENT DOCUMENTS 6,160,532 A * 12/2000 Kaburagi ..... G06F 3/1475 348/676
6,384,852 B1 * 5/2002 Ye ..... G09G 5/00 348/14.07
6,965,389 B1 * 11/2005 Masuji ..... G09G 3/2003 358/1.9
7,233,305 B1 * 6/2007 Orlando ..... G09G 3/3696 348/674
7,965,302 B2 * 6/2011 Lee ..... H04N 5/202 345/589
8,194,063 B2 * 6/2012 Levey ..... G09G 3/3208 345/64
2003/0001815 A1 * 1/2003 Cui ..... G09G 3/3406 345/102
2006/0001641 A1 * 1/2006 Degwekar ..... G09G 3/3406 345/102
2006/0050065 A1 * 3/2006 Maki ..... G09G 3/3688 345/204

(Continued)

*Primary Examiner* — Jose R Soto Lopez
(74) *Attorney, Agent, or Firm* — Ferguson Braswell Fraser Kubasta LLP

(57) ABSTRACT

A display driver includes image processing circuitry, driver circuitry, and test circuitry. The image processing circuitry is configured to generate first output data during a first display update period and generate second output data during a second display update period. The driver circuitry is configured to update a display panel based on the first output data during the first display update period and update the display panel based on the second output data during the second display update period. The test circuitry is configured to test the image processing circuitry during a test period disposed between the first display update period and the second display update period.

17 Claims, 18 Drawing Sheets

(56) References Cited

U.S. PATENT DOCUMENTS

2006/0139272 A1* 6/2006 Choi ..... G09G 3/006 345/89
2007/0252795 A1* 11/2007 Shiomi ..... G09G 3/3648 345/87
2008/0122813 A1* 5/2008 Kim ..... G09G 3/3648 345/204
2008/0225062 A1* 9/2008 Chang ..... G09G 3/3208 345/691
2009/0015543 A1* 1/2009 Wei ..... G09G 3/3406 345/102
2009/0109290 A1* 4/2009 Ye ..... G09G 3/3611 348/155
2010/0026722 A1* 2/2010 Kondo ..... H04N 17/00 345/660
2010/0033509 A1* 2/2010 Sawa ..... G09G 3/2066 345/60
2010/0225571 A1* 9/2010 Sakariya ..... G09G 3/2011 345/102
2011/0025665 A1* 2/2011 Bae ..... G09G 3/3208 345/211
2011/0149146 A1* 6/2011 Yun ..... G09G 3/3648 348/790
2012/0127148 A1* 5/2012 Lee ..... G09G 3/3688 345/212
2012/0169368 A1* 7/2012 Chen ..... G09G 3/006 324/764.01
2013/0069919 A1* 3/2013 Ryu ..... G09G 3/3611 345/204
2013/0249881 A1* 9/2013 Chae ..... G09G 3/3233 345/211
2013/0300878 A1* 11/2013 Chiu ..... H04N 17/04 348/189
2014/0375706 A1* 12/2014 Lee ..... G09G 3/3611 345/697
2015/0103104 A1* 4/2015 Lee ..... G09G 3/3648 345/690
2015/0138173 A1* 5/2015 Bae ..... G09G 3/3685 345/82
2016/0027355 A1* 1/2016 Tsuchi ..... G09G 3/006 345/690
2016/0080613 A1* 3/2016 Nagano ..... H04N 5/21 348/241
2016/0098966 A1* 4/2016 Kim ..... G09G 3/3614 345/690
2016/0104429 A1* 4/2016 Kang ..... G09G 3/3291 345/212
2016/0112188 A1* 4/2016 Choi ..... G09C 1/00 380/28
2016/0209977 A1* 7/2016 An ..... G06F 3/0412
2016/0322020 A1* 11/2016 Park ..... G09G 3/3406
2017/0061889 A1* 3/2017 Seo ..... G09G 3/3685
2017/0193890 A1* 7/2017 Kim ..... G09G 3/2092
2017/0221440 A1* 8/2017 Chen ..... G09G 3/3677
2017/0278441 A1* 9/2017 Ooki ..... G09G 3/3648
2018/0005587 A1* 1/2018 Ge ..... G09G 3/3233
2018/0024654 A1* 1/2018 Koike ..... G09G 3/20 345/174
2018/0090084 A1* 3/2018 Zheng ..... G09G 3/3611
2018/0188868 A1* 7/2018 Park ..... G06F 3/0412
2018/0308448 A1* 10/2018 Lee ..... H03K 5/24
2019/0012961 A1* 1/2019 Kim ..... G09G 3/3225
2019/0103073 A1* 4/2019 Choi ..... G09G 5/10
2019/0180662 A1* 6/2019 Wang ..... H02H 3/20
2019/0213936 A1* 7/2019 Cho ..... H01L 27/1244
2019/0294310 A1* 9/2019 Lee ..... G06F 3/04184
2019/0333196 A1* 10/2019 Kim ..... G09G 3/3648
2019/0340996 A1* 11/2019 Kim ..... G09G 3/3696
2019/0355291 A1* 11/2019 Kim ..... G09G 3/2003
2020/0112654 A1* 4/2020 Saito ..... H04N 5/202
2020/0279516 A1* 9/2020 Weng ..... G09G 3/3266
2020/0286448 A1* 9/2020 Kim ..... G09G 5/18
2020/0357338 A1* 11/2020 Lee ..... G09G 3/3258
2020/0402433 A1* 12/2020 Kim ..... G01R 31/2896
2021/0049966 A1* 2/2021 Hsu ..... G09G 3/3258
2021/0064170 A1* 3/2021 Hwang ..... G06F 3/0443
2021/0286578 A1* 9/2021 Seo ..... G06F 3/1423
2021/0327318 A1* 10/2021 Huang ..... G09G 3/006
2021/0366326 A1* 11/2021 Wang ..... G09G 3/20

* cited by examiner

BUILT-IN TEST OF A DISPLAY DRIVER

FIELD

The disclosed technology generally relates to built-in test of a display driver.

BACKGROUND

Display devices may be tested before shipping and/or at startup to improve reliability. To perform a before-shipping test and/or startup test, a display driver configured to drive a display panel may include built-in test circuitry.

SUMMARY

This summary is provided to introduce in a simplified form a selection of concepts that are further described below in the detailed description. This summary is not intended to identify key features or essential features of the claimed subject matter, nor is it intended to limit the scope of the claimed subject matter.

In one or more embodiments, a display driver is provided. The display driver includes image processing circuitry, driver circuitry, and test circuitry. The image processing circuitry is configured to generate first output data during a first display update period and generate second output data during a second display update period. The driver circuitry is configured to update a display panel based on the first output data during the first display update period and update the display panel based on the second output data during the second display update period. The test circuitry is configured to test the image processing circuitry during a test period disposed between the first display update period and the second display update period.

In one or more embodiments, a display system is provided. The display system includes a display panel and a display driver. The display driver comprises image processing circuitry, driver circuitry, and test circuitry. The image processing circuitry is configured to generate first output data during a first display update period and generate second output data during a second display update period. The driver circuitry is configured to update a display panel based on the first output data during the first display update period and update the display panel based on the second output data during the second display update period. The test circuitry is configured to test the image processing circuitry during a test period disposed between the first display update period and the second display update period.

In one or more embodiments, a method for driving a display panel is provided. The method includes: updating a display panel based on first output data generated by image processing circuitry during a first display update period; and updating the display panel based on second output data generated by the image processing circuitry during a second display update period. The method further includes testing the image processing circuitry during a test period disposed between the first display update period and the second display update period.

Other aspects of the embodiments will be apparent from the following description and the appended claims.

BRIEF DESCRIPTION OF DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments, and are therefore not to be considered limiting of inventive scope, as the disclosure may admit to other equally effective embodiments.

Figure 1:
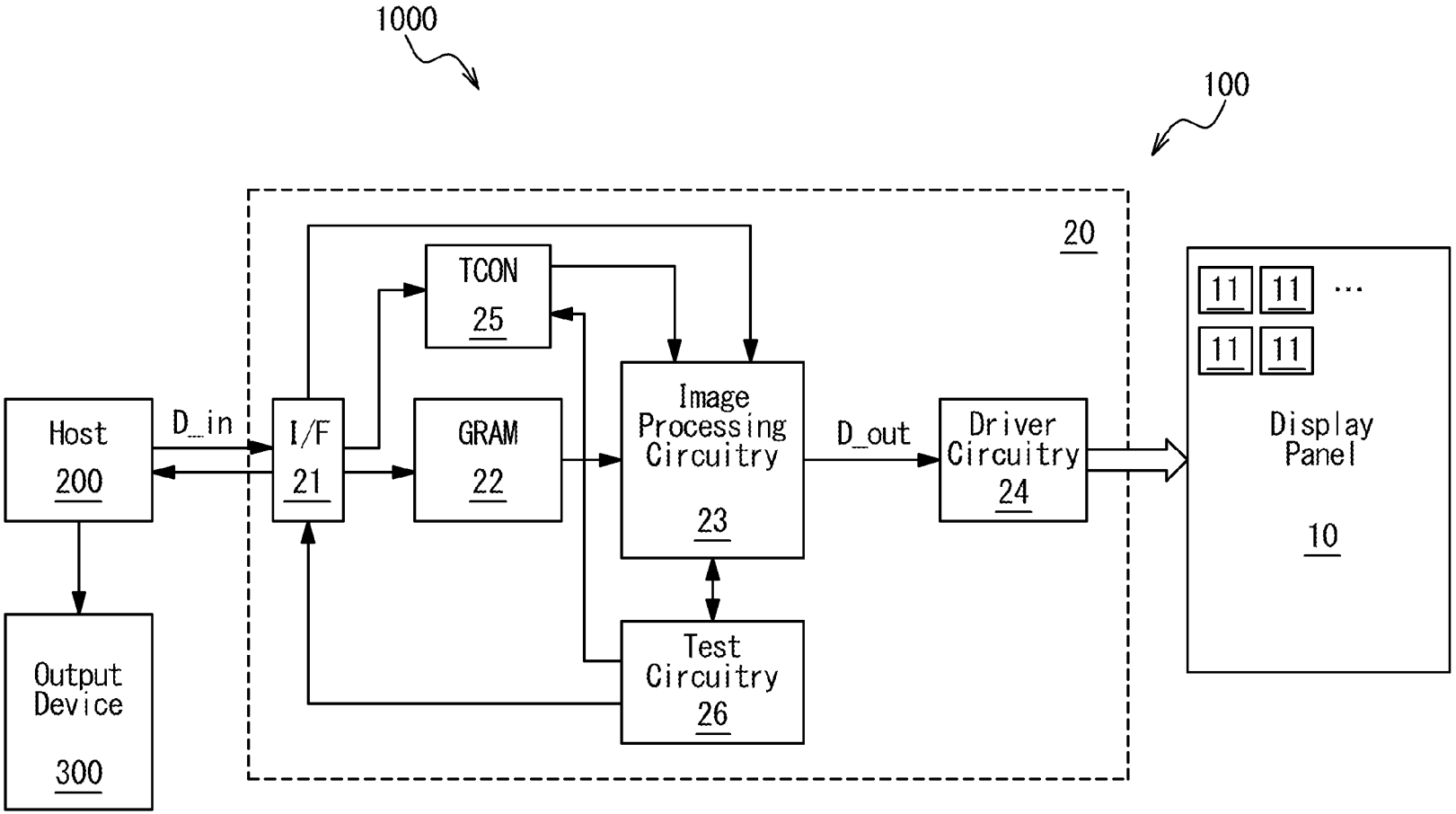
FIG. 1 illustrates an example configuration of a display system, according to one or more embodiments.

To facilitate understanding, identical reference numerals have been used, where possible, to designate identical elements that are common to the figures. It is contemplated that elements disclosed in one embodiment may be beneficially utilized on other embodiments without specific recitation. Suffixes may be attached to reference numerals for distinguishing identical elements from each other. The drawings referred to here should not be understood as being drawn to scale unless specifically noted. Also, the drawings are often simplified and details or components omitted for clarity of presentation and explanation. The drawings and discussion serve to explain principles discussed below, where like designations denote like elements.

DETAILED DESCRIPTION

The following detailed description is merely exemplary in nature and is not intended to limit the disclosure or the application and uses of the disclosure. Furthermore, there is no intention to be bound by any expressed or implied theory presented in the preceding background, summary, or the following detailed description.

Some sorts of display device may require higher reliability for example in view of safety. Examples of such display devices include automobile applications, such as car front displays, speed meters, rear-view displays, side-view displays. To improve reliability, display devises are usually tested before shipping and/or at startup. The before-shipping test and the startup test do not however address a circuit failure that occurs during actual operation (e.g., while displaying an image.)

The present disclosure provides various technologies for detecting a circuit failure that occurs during actual operation and offering measures against the failure. In one or more embodiments, a display panel is updated based on first output data generated by image processing circuitry during a first display update period, and based on second output data generated by the image processing circuitry during a second display update period. The image processing circuitry is tested during a test period disposed between the first display update period and the second display update period. This operation enables detecting a circuit failure that occurs during actual operation, for example, while an image is being displayed on the display panel.

FIG. 1 illustrates an example configuration of a display system 1000, according to one or more embodiments. In the illustrated embodiment, the display system 1000 includes a display module 100, a host 200, and an output device 300. Examples of the host 200 may include an application processor, a central processing unit (CPU) or other processors. Examples of output devices 300 may include a speaker, an alert lamp, or other devices configured to output an alert to the user.

The display module 100 includes a display panel 10 and a display driver 20. The display panel 10 may include a liquid crystal display (LCD) panel, an organic light emitting diode (OLED) display panel, and other types of display panels. The display panel 10 includes pixel circuits 11 (four illustrated) that may be arrayed in rows and columns. The display driver 20 is configured to update the pixel circuits 11 to display an image corresponding to image data D_in received from a host 200 on the display panel 10. Examples of the display driver 20 may include a display driver integrated circuit (DDIC), a touch display driver integration (TDDI) or other devices configured to drive the display panel 10.

In the illustrated embodiment, the display driver 20 includes interface (I/F) circuitry 21, a graphic random-access memory (GRAM) 22, image processing circuitry 23, driver circuitry 24, a timing controller (TCON) 25, and test circuitry 26. The interface circuitry 21 is configured to receive image data D_in from the host 200 and forward the received image data D_in to the GRAM 22. In other embodiments, the interface circuitry 21 may be configured to process the received image data and send the processed image data to the GRAM 22.

The GRAM 22 is configured to temporarily store the image data D_in and forward the stored image data D_in to the image processing circuitry 23. In other embodiments, the GRAM 22 may be omitted and the image data D_in may be directly supplied to the image processing circuitry 23 from the interface circuitry 21.

The image processing circuitry 23 is configured to apply desired image processing (e.g., color adjustment, subpixel rendering, image scaling, and gamma transformation) to the image data D_in received from the GRAM 22 to generate and supply output data D_out to the driver circuitry 24. The output data D_out may specify voltage levels of output voltages with which the pixel circuits 11 in the display panel 10 are to be updated.

The driver circuitry 24 is configured to drive or update the pixel circuits 11 based on the output data D_out. The driver circuitry 24 may be configured to generate output voltages having voltage levels as specified by the output data D_out and supply the generated output voltages to the corresponding pixel circuits 11.

The timing controller 25 is configured to provide timing control for the display driver 20. The timing control may define frame periods (or vertical sync periods), display update periods, and blanking periods. The timing controller 25 may be further configured to control the operation of the image processing circuitry 23.

The test circuitry 26 is configured to perform a built-in test of the image processing circuitry 23. The test circuitry 26 may be further configured to send a test result to the host 200 via the interface circuitry 21. The test circuitry 26 may be configured to send the test result to the timing controller 25 in place of or in addition to the host 200.

Figure 2:
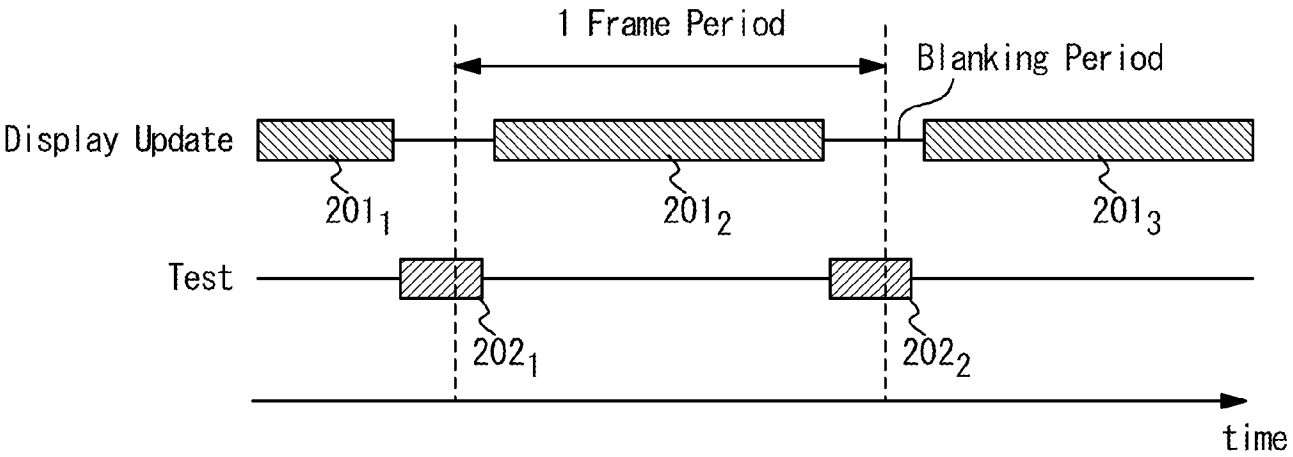
FIG. 2 illustrates an example test process, according to one or more embodiments.

In one or more embodiments, the test circuitry 26 is configured to test the image processing circuitry 23 during actual operation (e.g., while the display driver 20 is in operation to display an image on the display panel 10). FIG. 2 illustrates an example test process, according to one or more embodiments. In the illustrated embodiment, each frame period includes a display update period during which the pixel circuits 11 of the display panel 10 are updated by the display driver 20. In one implementation, the pixel circuits 11 of the entire display panel 10 are updated based on image data D_in defined for a frame image during the display update period of each frame period. In FIG. 2, first to third display update periods are illustrated and denoted by numeral $\mathbf{201}_1$ to $\mathbf{201}_3$, respectively. A blanking period is disposed between adjacent two display update periods. In one or more embodiments, the image processing circuitry 23 is configured to generate first output data during the first display update period $\mathbf{201}_1$ and second output data during the second display update period $\mathbf{201}_2$. In such embodiments, the driver circuitry 24 is configured to update the display panel 10 based on the first output data during the first display update period $\mathbf{201}_1$ and update the display panel 10 based on the second output data during the second display update period $\mathbf{201}_2$.

In the illustrated embodiment, the test circuitry 26 is configured to test the image processing circuitry 23 during a test period disposed between adjacent two display update periods 201 (e.g., in each blanking period.) In FIG. 2, first and second test periods $\mathbf{202}_1$ and $\mathbf{202}_2$ are illustrated, where the first test period $\mathbf{202}_1$ is disposed between the first display update period $\mathbf{201}_1$ and the second display update period $\mathbf{201}_2$ and the second test period $\mathbf{202}_2$ is disposed between the second display update period $\mathbf{201}_2$ and the third display update period $\mathbf{201}_3$. Disposing a test period 202 between adjacent two display update periods 201 enables testing the image processing circuitry 23 to detect a circuitry failure that occurs during the actual operation while the display driver 20 continues to display an image on the display panel 10.

Figure 3:
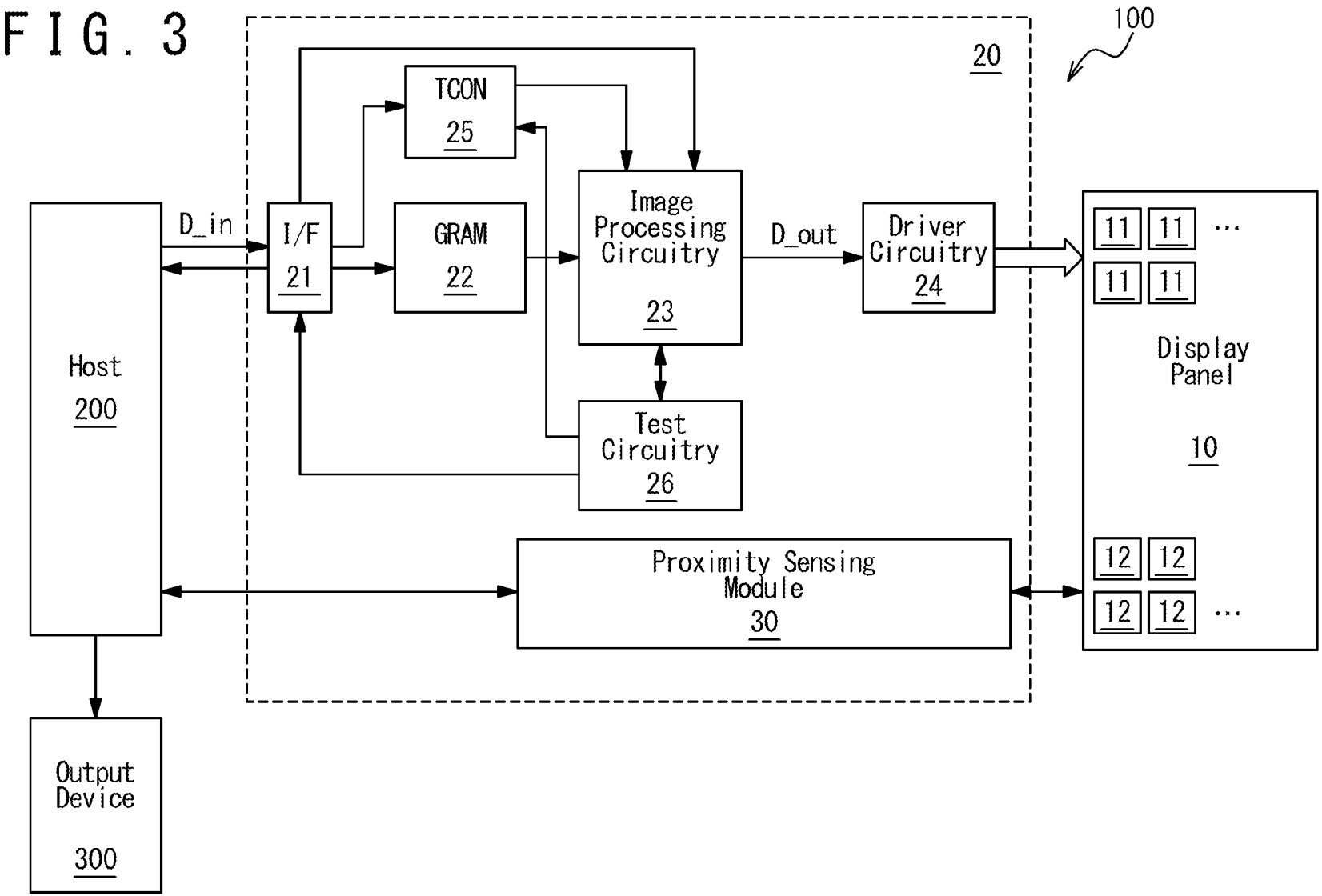
FIG. 3 illustrates example configurations of a display panel and a display driver, according to one or more embodiments.

In other embodiments, the display module 100 may be adapted to proximity sensing (e.g., touch sensing) to sense input provided by one or more input objects in a sensing region defined in the surface of the display panel 10. Example input objects include fingers and styli. FIG. 3 illustrates example configurations of the display panel 10 and the display driver 20, according to such embodiments. In the illustrated embodiment, the display panel 10 further comprises sensor elements 12 (four illustrated), and the display driver 20 further comprises a proximity sensing module 30 configured to sense one or more input objects based on resulting signals received from the sensor elements 12. The sensor elements 12 may each include a sensor electrode. In some implementations, the proximity sensing may be achieved through a self-capacitance (also often referred to as absolute capacitance) sensing method based on changes in the capacitive coupling between sensor elements 12 and an input object. In other implementations, the proximity sensing may be achieved through a mutual capacitance (also often referred to as transcapacitance) sensing method based on changes in the capacitive coupling between sensor elements 12. In one implementation, the mutual capacitance sensing method operates by detecting the capacitive coupling between one or more transmitter sensor electrodes and one or more receiver sensor electrodes.

In embodiments where the display module 100 is adapted to proximity sensing, a proximity sensing period may be disposed between adjacent two display update periods. In such embodiments, the proximity sensing module 30 may be configured to acquire resulting signals from the sensor elements 12 during the proximity sensing period and sense input provided by one or more input objects based on the resulting signals. The proximity sensing period may at least partially overlap a test period.

Figure 4:
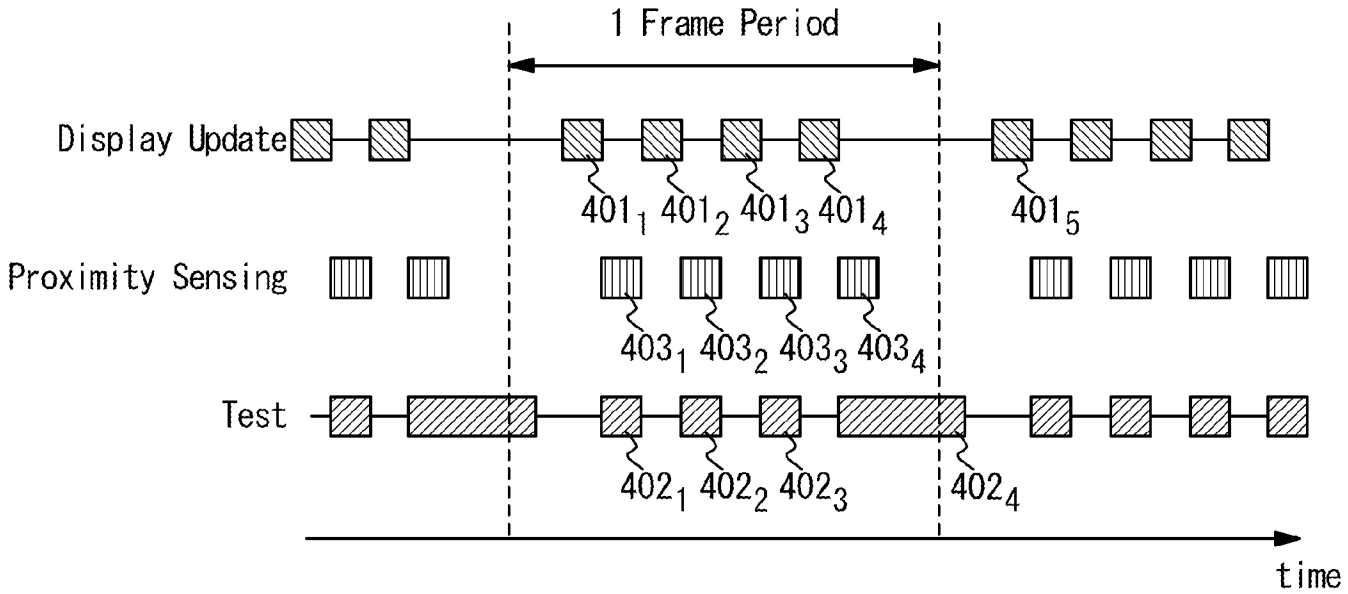
FIG. 4 illustrates an example test process, according to one or more embodiments.

FIG. 4 illustrates an example test process for the system configuration illustrated in FIG. 3, according to one or more embodiments. In one or more embodiments, each frame period includes a plurality of display update periods, and the pixel circuits 11 of the entire display panel 10 are updated in a time divisional manner. In one implementation, first part of the pixel circuits 11 of the display panel 10 may be updated during a first display update period, and second part of the pixel circuits 11 may be update during a second display update period. A similar may goes for the remaining display update period(s) in embodiments where each frame period includes three or more display update period. As a whole, the pixel circuits 11 of the entire display panel 10 are updated based on image data D_in defined for a frame image during the plurality of display update periods included in one frame period. In the illustrated embodiment, each frame period includes four display update periods. In FIG. 4, numeral $\mathbf{401}_1$, $\mathbf{401}_2$, $\mathbf{401}_3$ and $\mathbf{401}_4$ denote first to fourth display update periods disposed in a frame period, and numeral $\mathbf{401}_5$ denotes a fifth display update period in the next frame period. A test period during which the image processing circuitry 23 is tested is disposed between adjacent two display update periods. In FIG. 4, numeral $\mathbf{402}_1$, $\mathbf{402}_2$, $\mathbf{402}_3$, and $\mathbf{402}_4$ denote test periods, where the test periods $\mathbf{402}_1$, $\mathbf{402}_2$, $\mathbf{402}_3$, and $\mathbf{402}_4$ are disposed between the display update periods $\mathbf{401}_1$ and $\mathbf{401}_2$, between the display update periods $\mathbf{401}_2$ and $\mathbf{401}_3$, between the display update periods $\mathbf{401}_3$ and $\mathbf{401}_4$, and between the display update periods $\mathbf{401}_4$ and $\mathbf{401}_5$, respectively. Furthermore, a proximity sensing period is disposed between adjacent two display update periods. In FIG. 4, numeral $\mathbf{403}_1$, $\mathbf{403}_2$ and $\mathbf{403}_4$ denote proximity sensing periods. In the illustrated embodiment, the proximity sensing periods $\mathbf{403}_1$ to $\mathbf{403}_4$ overlap the test periods $\mathbf{402}_1$ to $\mathbf{402}_4$, respectively.

Figure 5A:
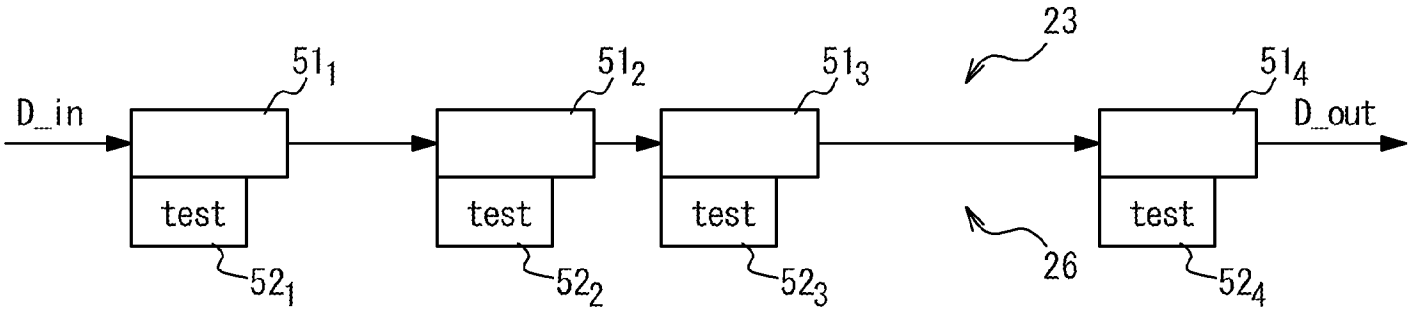
FIG. 5A illustrates example configurations of image processing circuitry and test circuitry, according to one or more embodiments.

FIG. 5A illustrates example configurations of the image processing circuitry 23 and the test circuitry 26, according to one or more embodiments. The image processing circuitry 23 may include a plurality of image processing components 51 connected in series to process the image data D_in. In the illustrated embodiment, the image processing circuitry 23 includes first to fourth image processing components $\mathbf{51}_1$, $\mathbf{51}_2$, $\mathbf{51}_3$ and $\mathbf{51}_4$. The test circuitry 26 may include a plurality of test components 52 configured to test corresponding image processing components 51, respectively. In the illustrated embodiment, four test components $\mathbf{52}_1$, $\mathbf{52}_2$, $\mathbf{52}_3$ and $\mathbf{52}_4$ are configured to test the first to fourth image processing components $\mathbf{51}_1$ to $\mathbf{51}_4$, respectively.

Figure 5B:
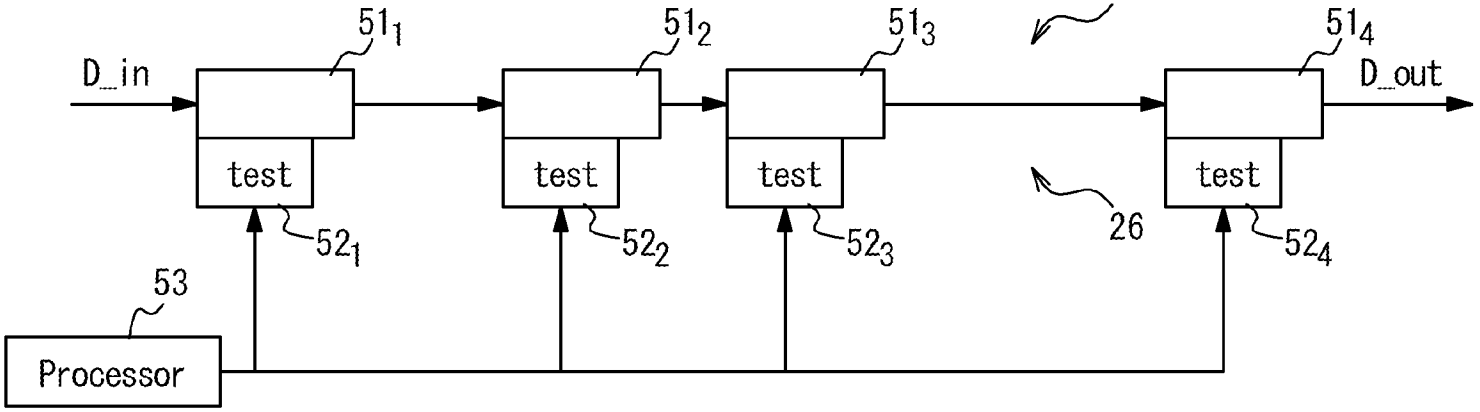
FIG. 5B illustrates example configurations of image processing circuitry and test circuitry, according to other embodiments.

The test circuitry 26 may be configured to generate one or more test patterns (which may include test images) and one or more test parameters to be provided to the image processing components 51 under test. The test circuitry 26 may be further configured to generate expected values of the outputs of the respective image processing components 51 and compare outputs of the image processing components 51 with the expected values. The expected values may be defined for a corresponding test pattern or test image. In embodiments where the display driver 20 further include a processor 53 as illustrated in FIG. 5B, the processor 53 may be configured to generate test patterns, test parameters, and/or expected values. The processor 53 may be further configured to compare the outputs of the image processing components 51 with the expected values.

Figure 6:
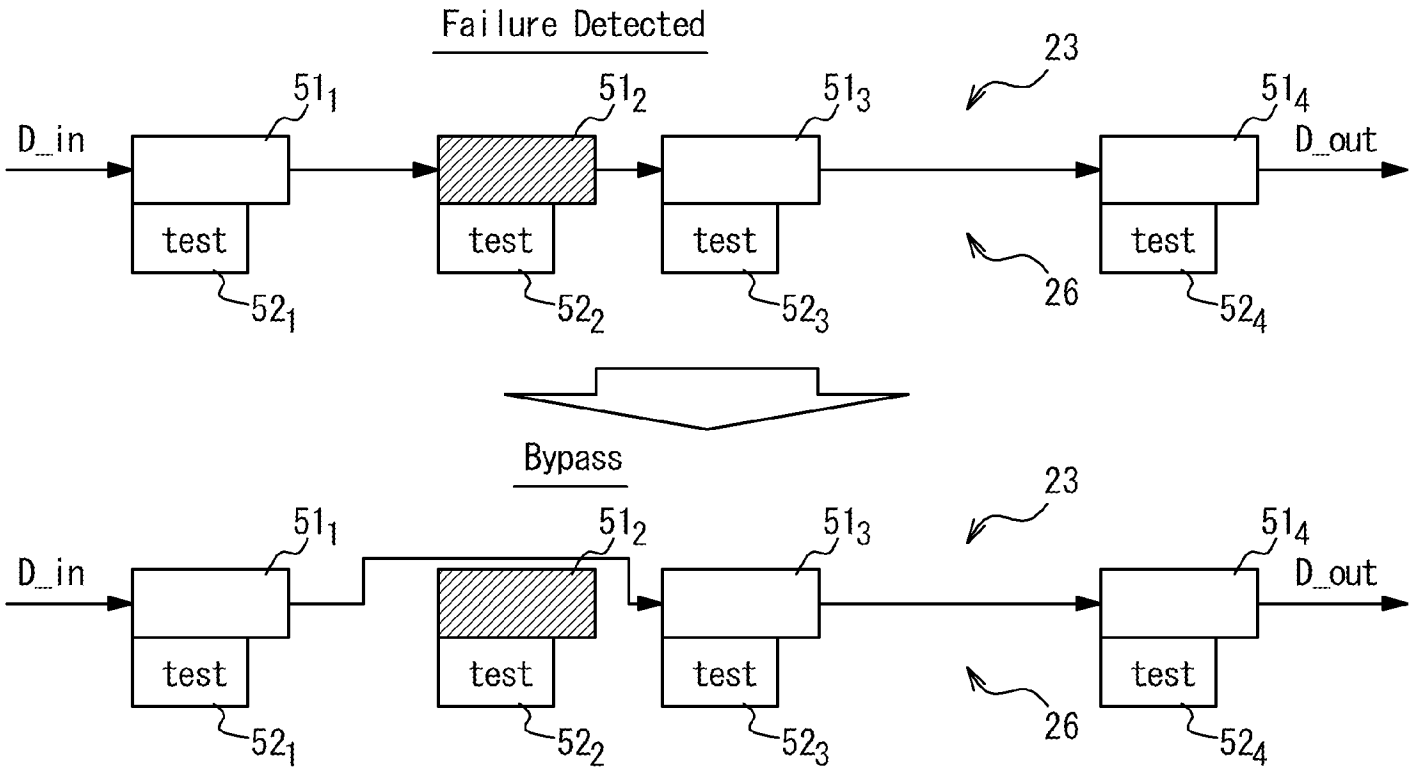
FIG. 6 illustrates an example operation of image processing circuitry, according to one or more embodiments.

The image processing circuitry 23 may be configured to be reconfigurable based on a test result acquired by the test circuitry 26. FIG. 6 illustrates an example operation of the image processing circuitry 23 thus configured, according to one or more embodiments. In one implementation, the image processing circuitry 23 may be configured to, in response to a detection of a failure in an image processing component 51 (e.g., the second image processing component $\mathbf{51}_2$ as illustrated in FIG. 6), bypass the image processing component 51 that is suffering the failure to generate the output data D_out. Bypassing the failed image processing component may mitigate an effect of the failure on the image display.

Figure 7:
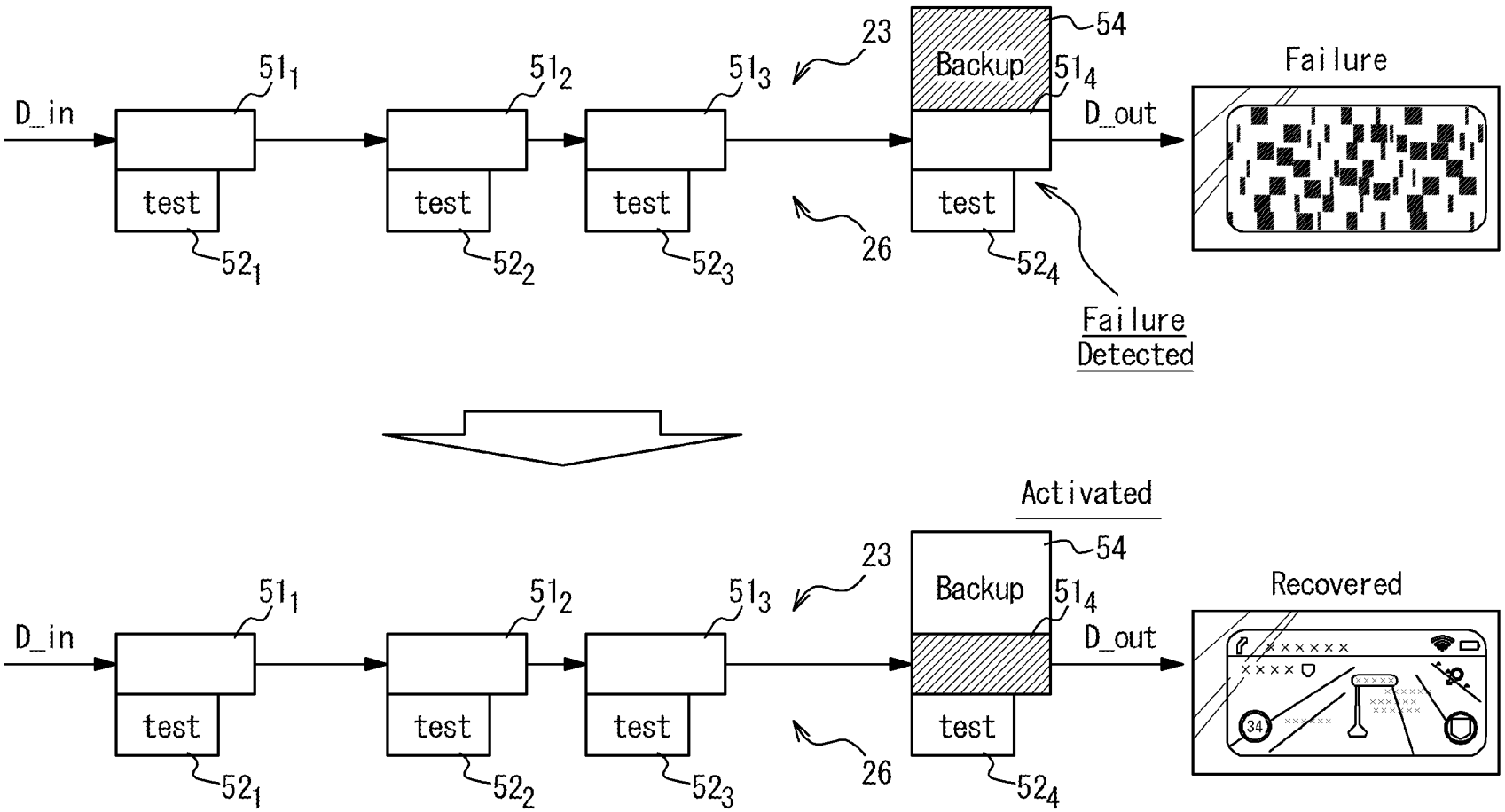
FIG. 7 illustrates an example configuration and operation of image processing circuitry, according to one or more embodiments.

FIG. 7 illustrates an example configuration and operation of the image processing circuitry 23, according to other embodiments. The image processing circuitry 23 may further include a backup image processing component 54 for an image processing component 51 to maintain normal display in case a failure occurs in the image processing component 51. In the illustrated embodiment, the backup image processing component 54 is configured to perform the same image processing as the fourth image processing component $\mathbf{51}_4$. The fourth image processing component $\mathbf{51}_4$ and the backup image processing component 54 may be both configured to perform a gamma transformation or different image processing that may cause a significant effect on a displayed image. The image processing circuitry 23 may be configured to deactivate the backup image processing component 54 in a normal operation. The image processing circuitry 23 may be further configured to, in response to a detection of a failure in the fourth image processing component $\mathbf{51}_4$, activate the backup image processing component 54 and deactivate the fourth image processing component $\mathbf{51}_4$. This may effectively avoid abnormal display. Although FIG. 7 shows only the fourth image processing component as having a corresponding backup image processing component, any of the image processing component may have a backup image processing component.

Figure 8A:
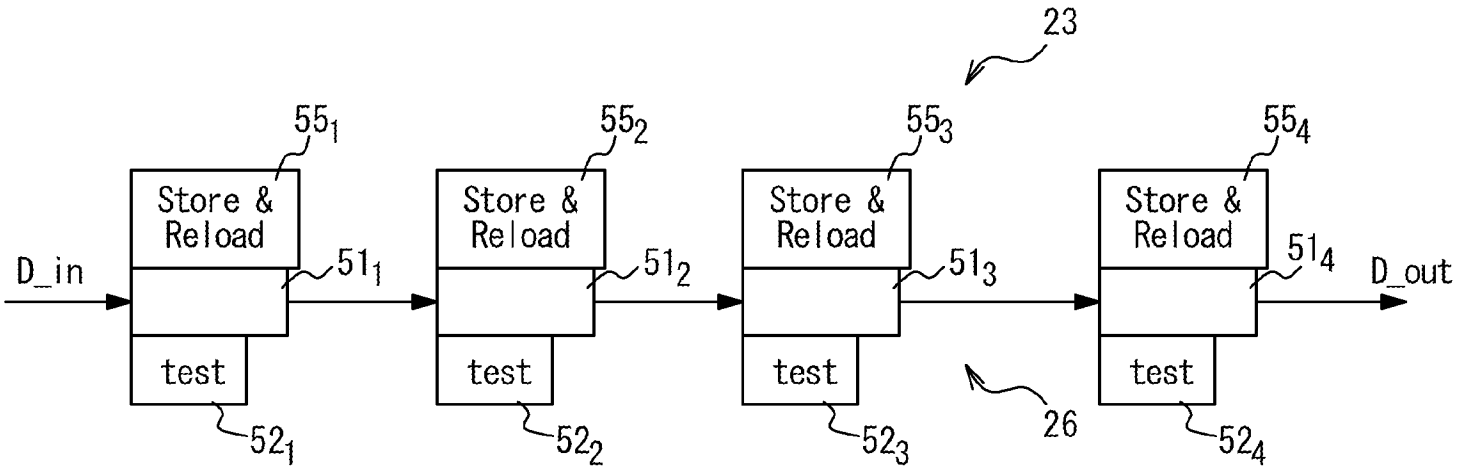
FIG. 8A illustrates an example configuration of image processing circuitry, according to one or more embodiments.
Figure 8B:
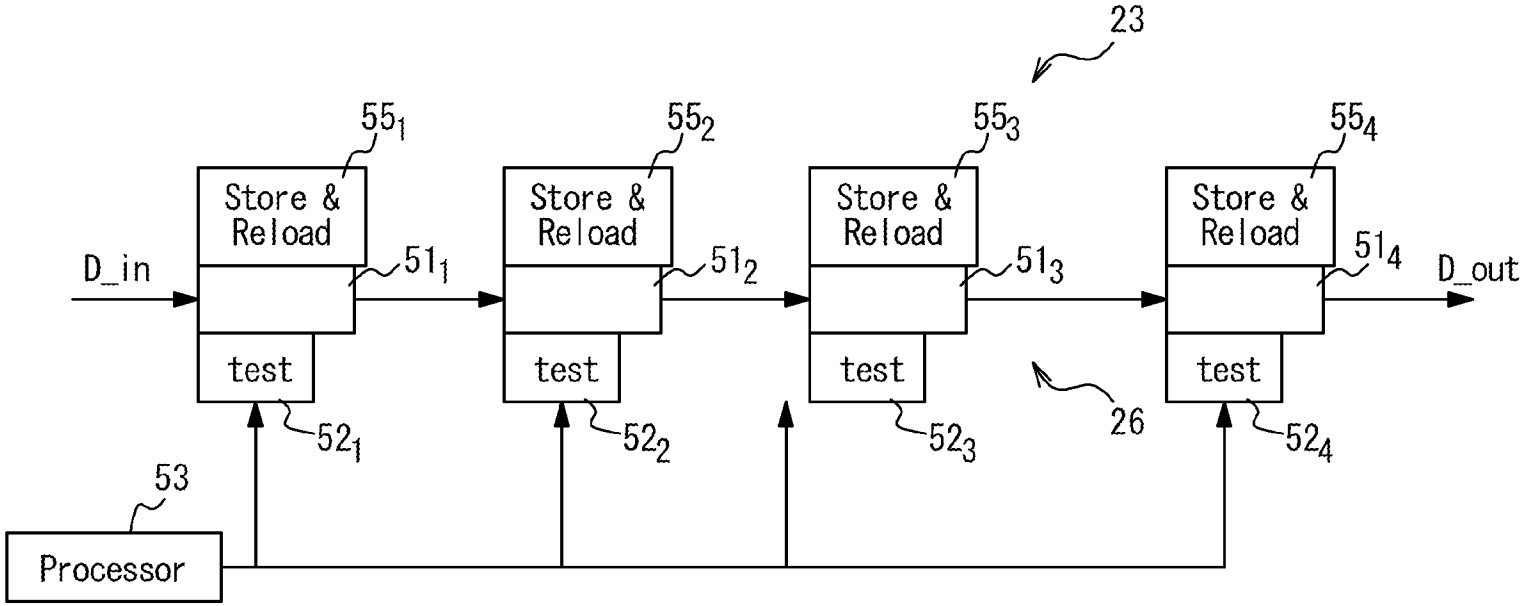
FIG. 8B illustrates an example configuration of image processing circuitry, according to other embodiments.

FIG. 8A illustrates an example configuration of the image processing circuitry 23, according to other embodiments. In the illustrated embodiment, the image processing circuitry 23 includes storage circuitry $\mathbf{55}_1$, $\mathbf{55}_2$, $\mathbf{55}_3$, and $\mathbf{55}_4$ connected to the first to fourth image processing components $51_1$, $51_2$, $51_3$, and $51_4$, respectively. In various embodiments, the first to fourth image processing components $51_1$ to $51_4$ are configured to generate intermediate data in generating the output data D_out. In some embodiments, the first to fourth image processing components $51_1$ to $51_4$ may be configured to generate intermediate data used to generate output data D_out during a first display update period (e.g., the display update period $201_2$ illustrated in FIG. 2) and use the intermediate data generated during the first display update period to generate output data D_out during a second display update period (e.g., the display update period $201_3$) that follows the first display update period. The first to fourth image processing components $51_1$ to $51_4$ may be tested by the test components $52_1$ to $52_4$ during a test period (e.g., the test period $202_2$) disposed between the first and second display update periods. In such embodiments, the first to fourth image processing components $51_1$ to $51_4$ may be configured to store the intermediate data in the storage circuitry $55_1$ to $55_4$, respectively, before the test period, and reload or acquire the intermediate data from the storage circuitry $55_1$ to $55_4$, respectively, after the test period. The storage and reloading may effectively avoid the intermediate data being destroyed by the test performed during the test period. In embodiments where the display driver 20 further includes a processor 53 as illustrated in FIG. 8B, the processor 53 may be configured to generate and provide test images, test parameters, and/or expected values to the test components $52_1$ to $52_4$. The processor 53 may be further configured to compare the outputs of the image processing components 51 with the expected values.

Figure 9A:
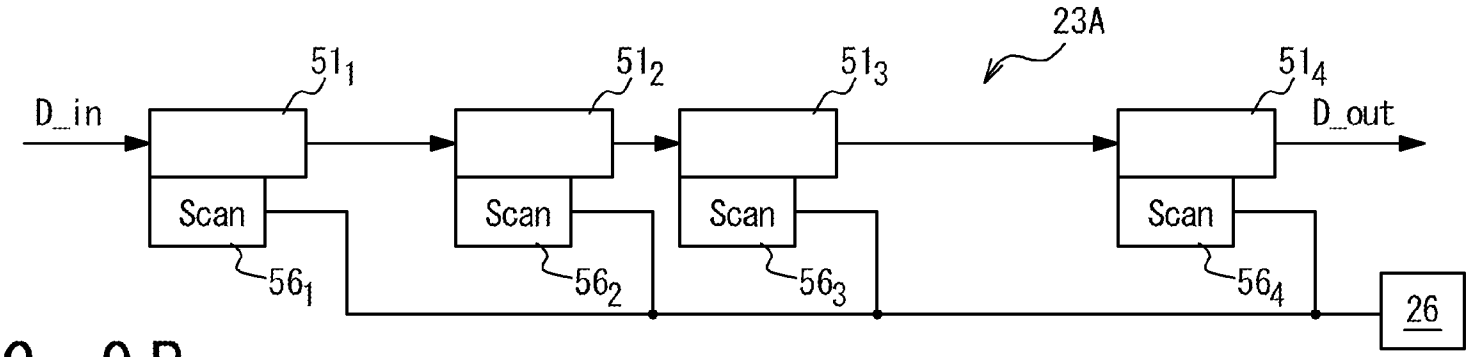
FIG. 9A illustrates an example configuration of image processing circuitry, according to one or more embodiments.
Figure 9B:
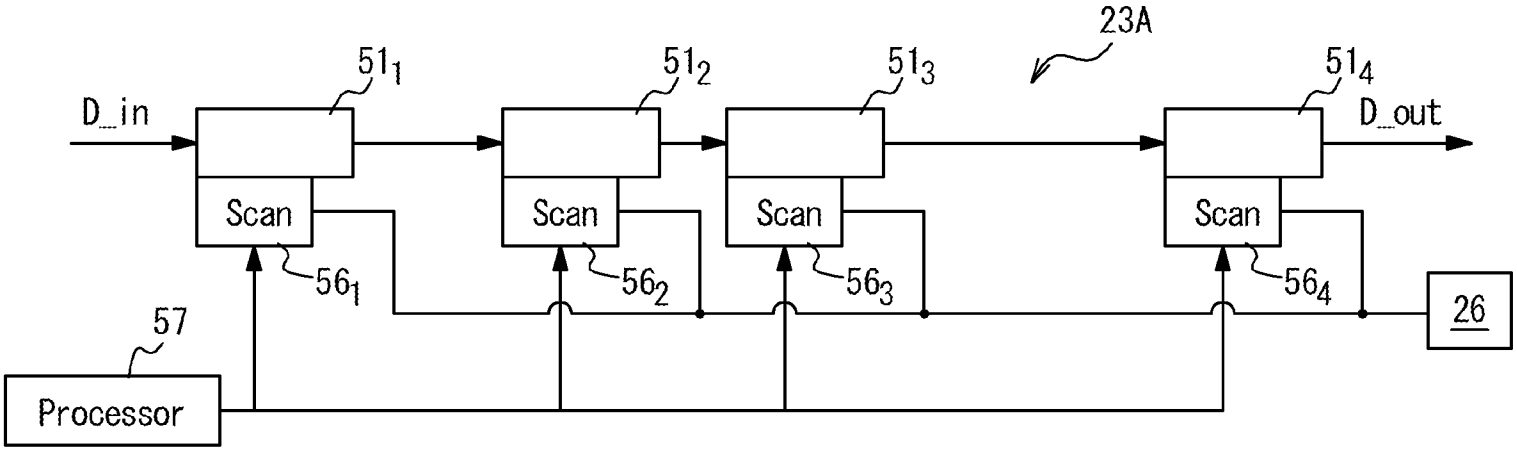
FIG. 9B illustrates an example configuration of image processing circuitry, according to other embodiments.

FIG. 9A illustrates an example configuration of image processing circuitry, denoted by numeral 23A, according to still other embodiments. In the illustrated embodiment, the first to fourth image processing components $51_1$, $51_2$, $51_3$, and $51_4$ include scan chains $56_1$, $56_2$, $56_3$, and $56_4$, respectively, to achieve boundary scan testing. Each of the scan chains $56_1$ to $56_4$ includes serially-connected scan flipflops (or boundary scan cells) that form a shift register. The scan chains $56_1$ to $56_4$ are configured to provide test patterns to the first to fourth image processing components $51_1$ to $51_4$ and capture combinational logic results from the first to fourth image processing components $51_1$ to $51_4$ for the test patterns. The captured combinational logic results are shifted out of the scan chains $56_1$ to $56_4$ and compared with expected values by the test circuitry 26 to detect a circuit failure in the first to fourth image processing components $51_1$ to $51_4$. In embodiments where the display driver 20 further includes a processor 57 as illustrated in FIG. 9B, the processor 57 may be configured to generate the test patterns and/or the expected values. The processor 57 may be further configured to compare the captured combinational logic results from the first to fourth image processing components $51_1$ to $51_4$ with the expected values.

Figure 10A:
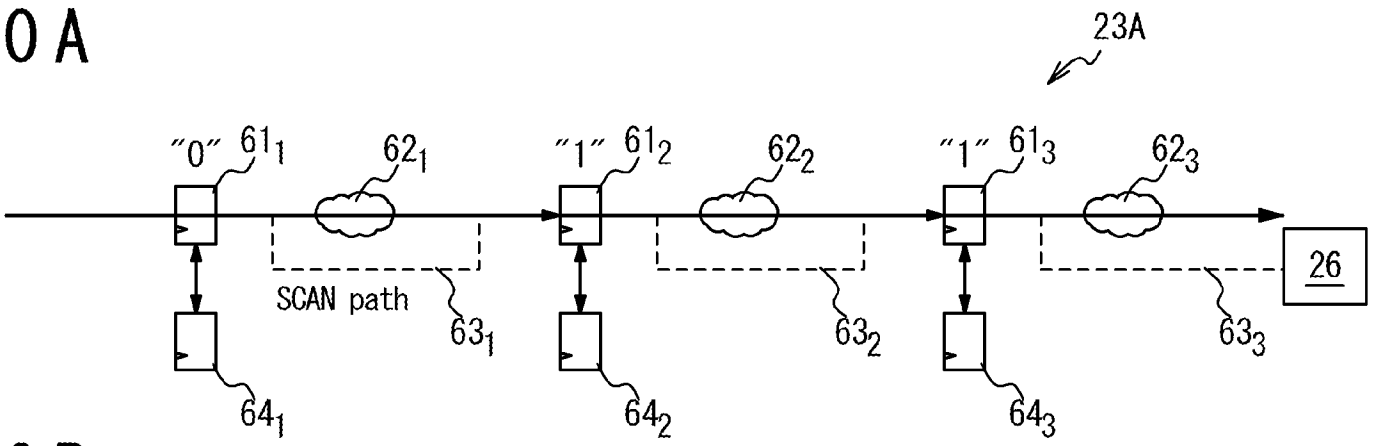
FIG. 10A, FIG. 10B, FIG. 10C, FIG. 10D, and FIG. 10E illustrate an example procedure of a boundary scan test, according to one or more embodiments.

FIG. 10A illustrates an example partial configuration of an image processing component (e.g., the first to fourth image processing components $51_1$ to $51_4$) disposed in the image processing circuitry 23A, according to one or more embodiments. In the illustrated embodiment, the image processing component includes a plurality of scan flipflops (or scan cells) $61_1$, $61_2$, and $61_3$ and a plurality of combinational circuits $62_1$, $62_2$, and $62_3$. In the illustrated embodiment, the scan flipflop $61_1$ includes a data input configured to receive an external input and a data output connected to an input of the combinational circuit $62_1$. The scan flipflop $61_2$ includes a data input connected to an output of the combinational circuit $62_1$ and a data output connected to an input of the combinational circuit $62_2$. The scan flipflop $61_3$ includes a data input connected to an output of the combinational circuit $62_2$ and a data output connected to an input of the combinational circuit $62_3$. The scan flipflops $61_1$, $61_2$, and $61_3$ are serially connected via scan paths $63_1$ and $63_2$ to form a scan chain (e.g., the scan chains $56_1$ to $56_4$).

In the illustrated embodiment, the image processing component further includes data save flipflops $64_1$, $64_2$, and $64_3$ connected to the scan flipflops $61_1$, $61_2$, and $61_3$, respectively. The data save flipflops $64_1$ to $64_3$ are configured to receive and store data from the scan flipflops $61_1$ to $61_3$, respectively, and further configured to restore the data to the scan flipflops $61_1$ to $61_3$, respectively. In one implementation, the data save flipflops $64_1$ to $64_3$ are used to suspend and resume the actual operation of the relevant image processing component and/or the boundary scan testing to detect a circuitry failure in the relevant image processing component.

FIGS. 10A to 10E illustrate an example procedure of a boundary scan test, according to one or more embodiments. In one implementation, upon completion of image processing in a first display update period (e.g., the display update period $201_2$ illustrated in FIG. 2), the scan flipflops $61_1$ to $61_3$ stores therein data generated in the image processing as illustrated in FIG. 10A. In the illustrated embodiment, the scan flipflops $61_1$ to $61_3$ stores data "0", "1", and "1", respectively, at the end of the first display update period.

Figure 10B:
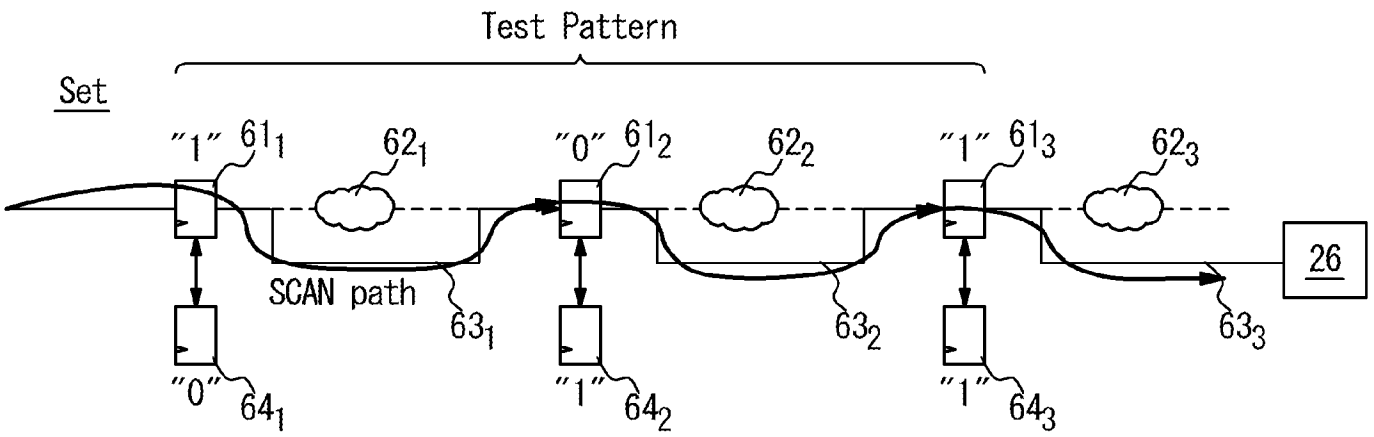

The boundary scan test is performed during a test period (e.g., the test period $202_2$) between the first display update period and a second display update period (e.g., the display update period $201_3$) after the first display update period. Before the start of the test period, the data stored in the scan flipflops $61_1$ to $61_3$ are saved in the data save flipflops $64_1$ to $64_3$. In the illustrated embodiment, as illustrated in FIG. 10B, the data save flipflops $64_1$ to $64_3$ captures data "0", "1", and "1" from the scan flipflops $61_1$ to $61_3$. This is followed by setting a test pattern to the scan flipflops $61_1$ to $61_3$. In the illustrated embodiment, test data "1", "0", "1" are set to the scan flipflops $61_1$ to $61_3$, respectively. In one implementation, the display driver 20 is placed in a scan shift mode, and the test pattern is then shifted into the scan chain that incorporates the scan flipflops $61_1$ to $61_3$ via the scan paths $63_1$ and $63_2$.

Figure 10C:
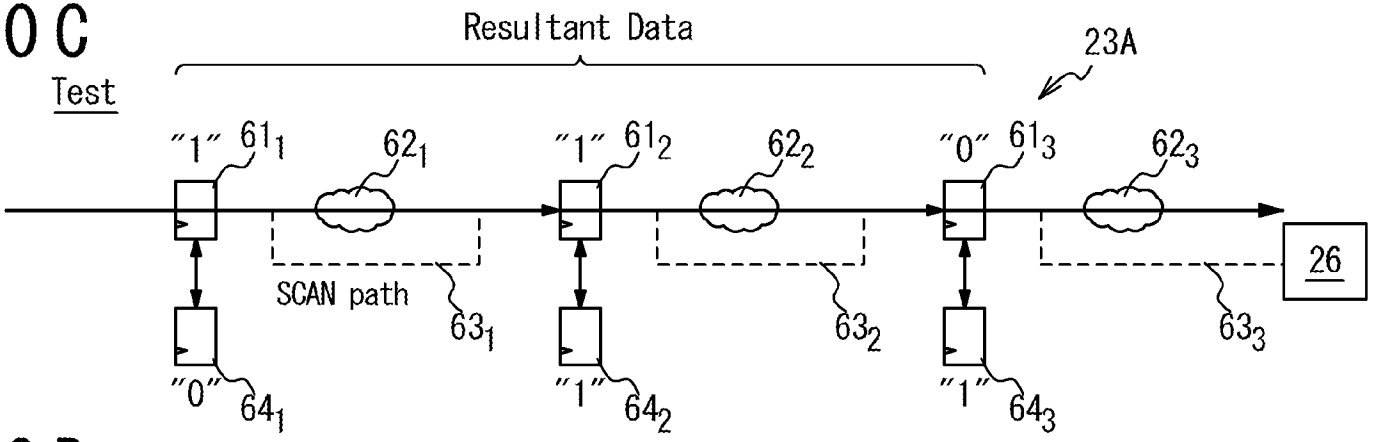
Figure 10D:
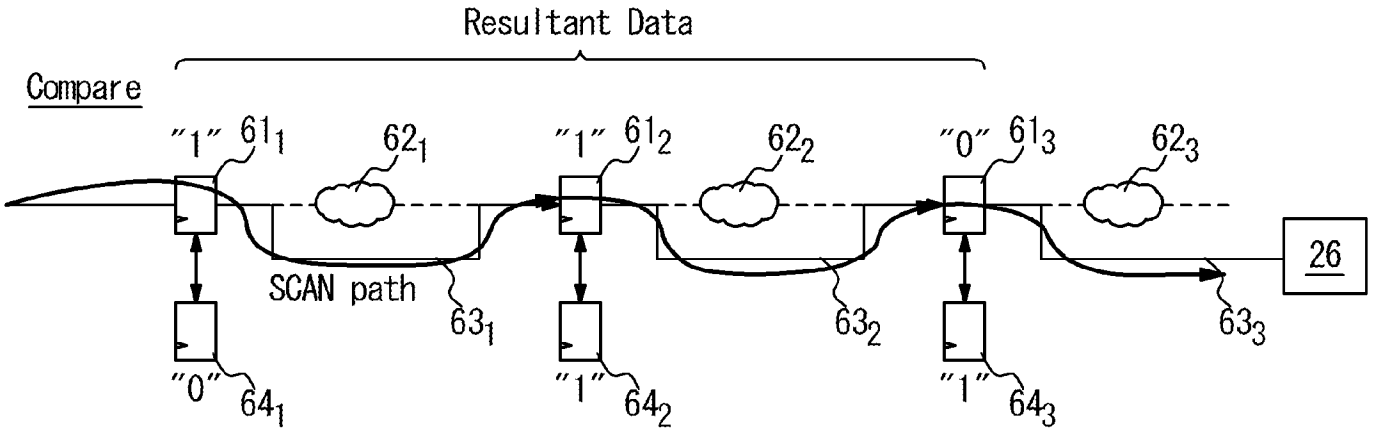

Once the test pattern has been shifted in, as illustrated in FIG. 10C, the scan shift mode is disabled and resultant data (or combinational logic results) generated at the outputs of the combinational circuits $62_1$ and $62_2$ are captured by the scan flipflops $61_2$ to $61_3$ to test the combinational circuits $62_1$ and $62_2$. In the illustrated embodiment, resultant data "1", "1", and "0" are captured by the scan flipflops $61_2$ to $61_3$. The resultant data are then shifted out of the scan chain via the scan paths $61_1$ to $61_3$ and compared with expected values to detect a circuit failure, as illustrated in FIG. 10D.

Figure 10E:
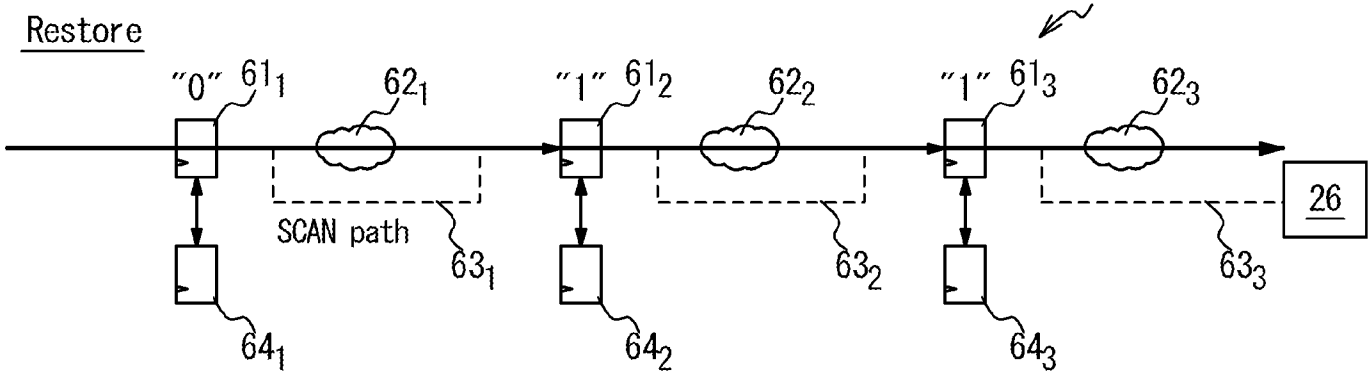

This is followed by restoring the intermediate data from the data save flipflops 641 to 643 to the scan flipflops 611 to 613 as illustrated in FIG. 10E. In the illustrated embodiment, data "0", "1", and "1", which were originally stored in the scan flipflops 611 to 613 at the end of the first display update period are restored to the scan flipflops 611 to 613. Image processing is then performed using the restored data in the second display update period.

Figure 11:
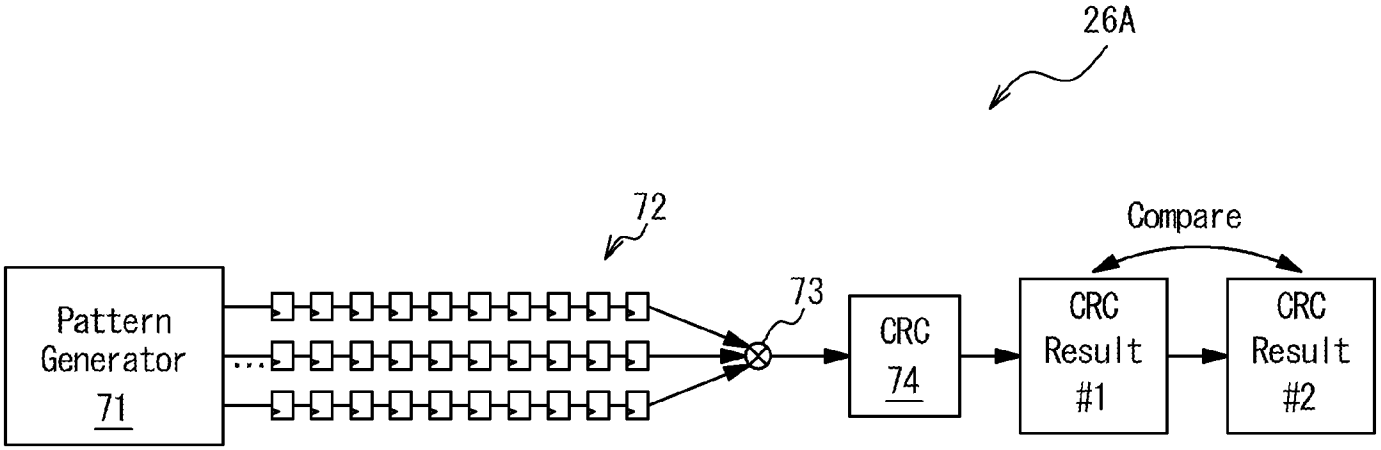
FIG. 11 illustrates an example configuration of test circuitry, according to one or more embodiments.

FIG. 11 illustrates an example configuration of test circuitry, denoted by numeral 26A, according to one or more embodiments. The test circuitry 26A is adapted to a parallel scan scheme to shorten the test time. In the illustrated embodiment, the test circuitry 26A is configured to accommodate a plurality of scan chains connected in parallel, which are denoted by numeral 72. The plurality of scan chains 72 may be integrated in image processing circuitry (e.g., the image processing circuitry 23A illustrated in FIG. 9). The test circuitry 26A may include pattern generator circuitry 71 configured to provide test patterns to the scan chains 72 and synthesizing circuitry 73 configured to synthesize the outputs of the scan chains 72 to generate a synthesized scan result. A circuit failure of the image processing circuitry may be detected based on the synthesized scan result. The synthesizing circuitry 73 may be configured as XOR circuitry that calculates the XOR of the outputs of the scan chains 72 or multiplier circuitry that calculates the logical product of the outputs of the scan chains 72.

The test circuitry 26A may further include cyclic redundancy check (CRC) coding circuitry 74 configured to generate a cyclic redundancy code for the synthesized scan result received from the synthesizing circuitry 73. The cyclic redundancy code may be generated for each test period. In some embodiments, the same test patterns are generated by the pattern generator circuitry 71 in a first test period and a second test period that follows the first test period, and cyclic redundancy codes #1 and #2 are generated for the first test period and the second test period, respectively. In such embodiments, a circuit failure may be detected based on comparison of cyclic redundancy codes #1 and #2. This scheme eliminates the need of generating expected values for boundary scan testing, facilitating an implementation of boundary scan testing.

Figure 12:
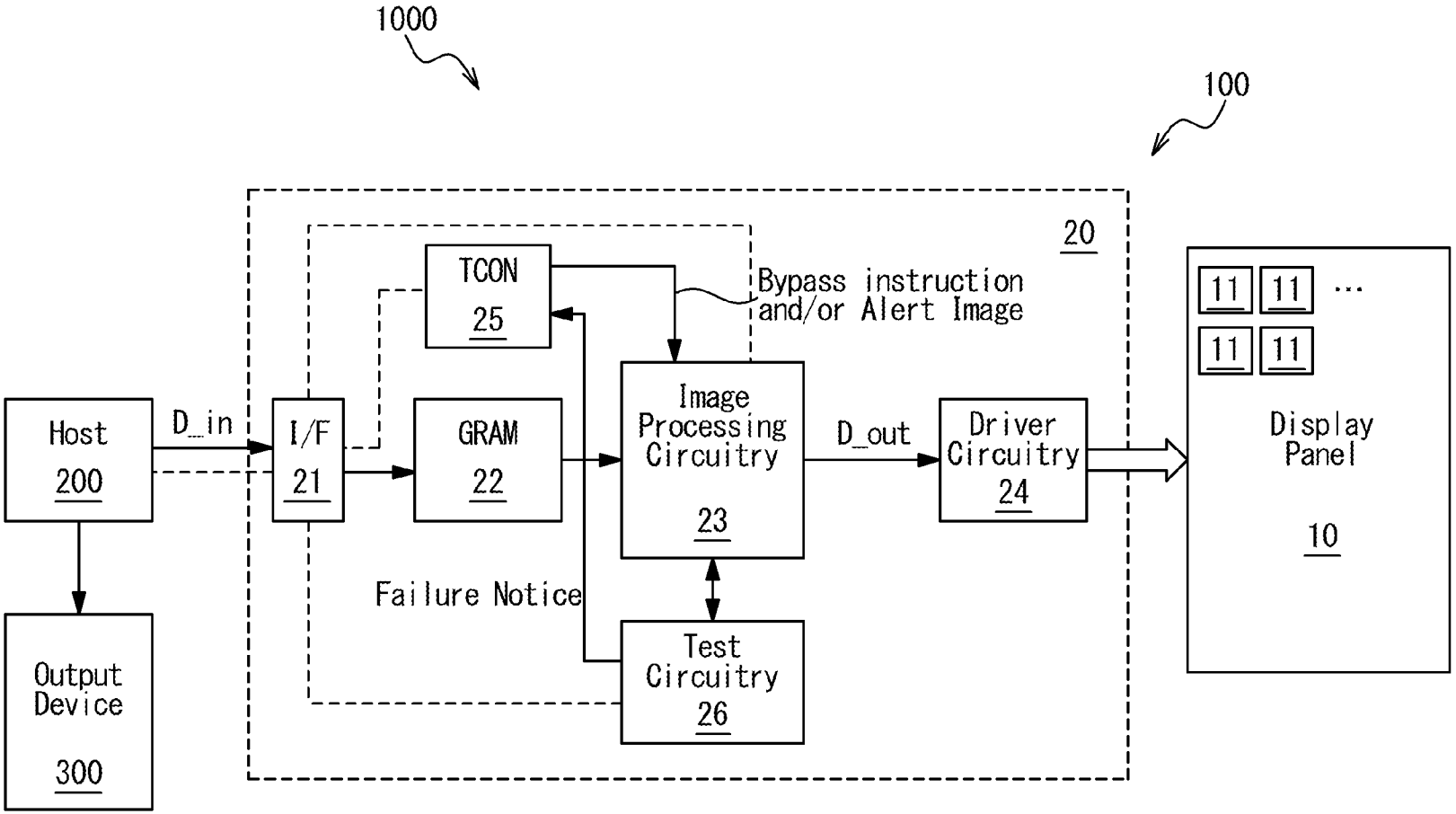
FIG. 12 illustrates an example operation of a display system when a circuit failure is detected, according to one or more embodiments.

FIG. 12 illustrates an example operation of the display system 1000 when a circuit failure is detected, according to one or more embodiments. In the illustrated embodiment, the test circuitry 26 is configured to send a failure notice to the timing controller 25 when detecting a failure in the image processing circuitry 23. The failure notice may indicate an image processing component that is experiencing the failure. The timing controller 25 may provide a bypass instruction to the image processing circuitry 23 based on the failure notice. The bypass instruction may instruct the image processing circuitry 23 to bypass the image processing component that is experiencing the failure to generate the output data D_out. The timing controller 25 may further provide alert image data to the image processing circuitry 23. The alert image data may represent an alert image that notifies the user of the occurrence of the failure. The image processing circuitry 23 generates the output data D_out based on the alert image data to display the alert image on the display panel 10.

Figure 13:
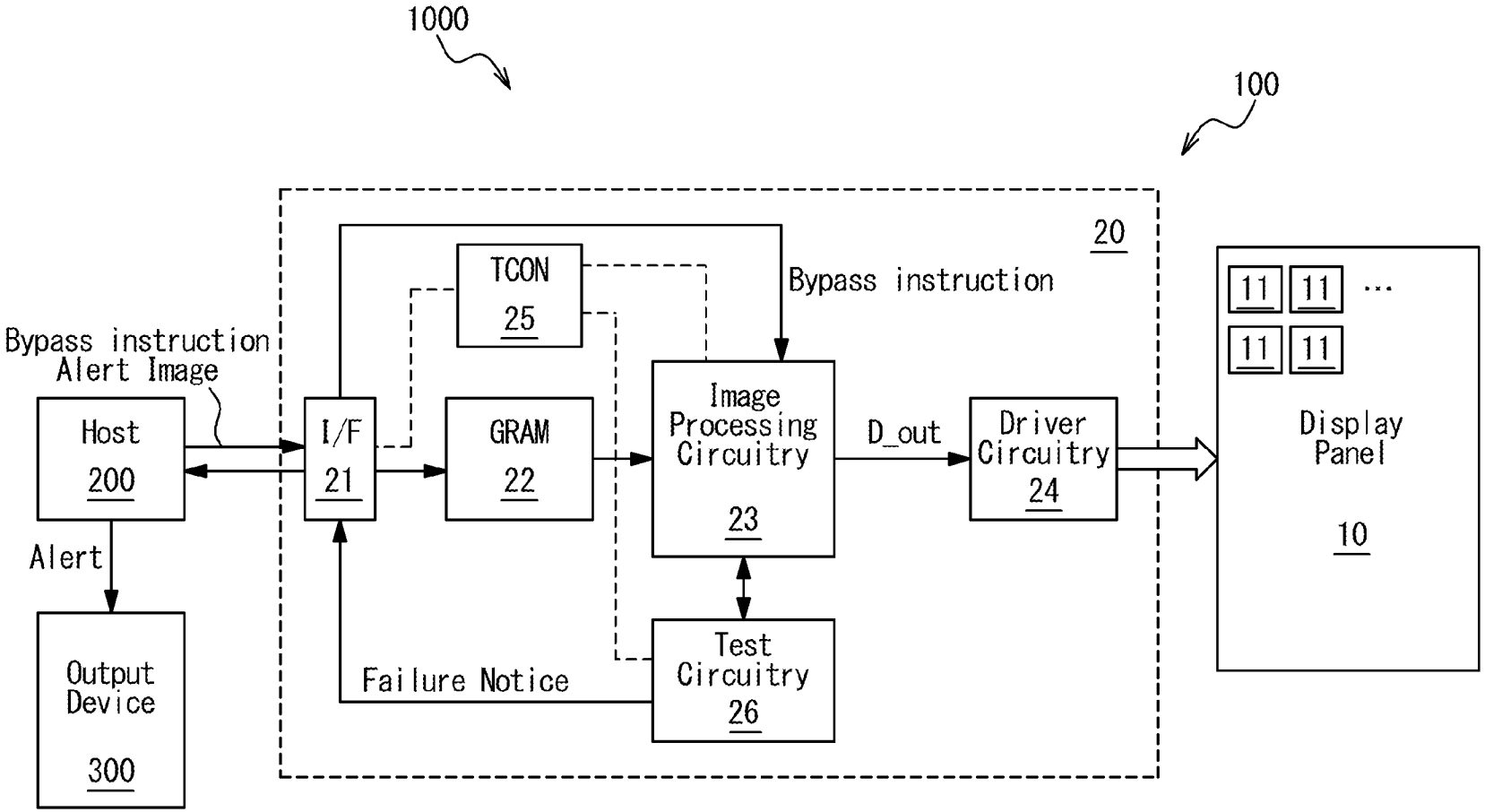
FIG. 13 illustrates an example operation of a display system when a circuit failure is detected, according to other embodiments.

FIG. 13 illustrates an example operation of the display system 1000 when a circuit failure is detected, according to other embodiments. In the illustrated embodiment, the test circuitry 26 is configured to send a failure notice to the host 200 when detecting a failure in the image processing circuitry 23. The host 200 may provide a bypass instruction to the image processing circuitry 23 via the interface circuitry 21 based on the failure notice. The bypass instruction may instruct the image processing circuitry 23 to bypass the image processing component that is experiencing the failure to generate the output data D_out. The host 200 may further operate the output device 300 to output an alert in response to the failure notice. In embodiments where the output device 300 includes a speaker, the host 200 may be configured to operate the speaker in response to the failure notice to generate alert sound. In embodiments where the output device 300 includes an alert lamp, the host 200 may be configured to turn on the alert lamp in response to the failure notice. Additionally, or alternatively, the host 200 may further provide alert image data to the display driver 20, and the alert image data may be transferred to the image processing circuitry 23. The image processing circuitry 23 generates the output data D_out based on the alert image data to display the alert image on the display panel 10.

Figure 14:
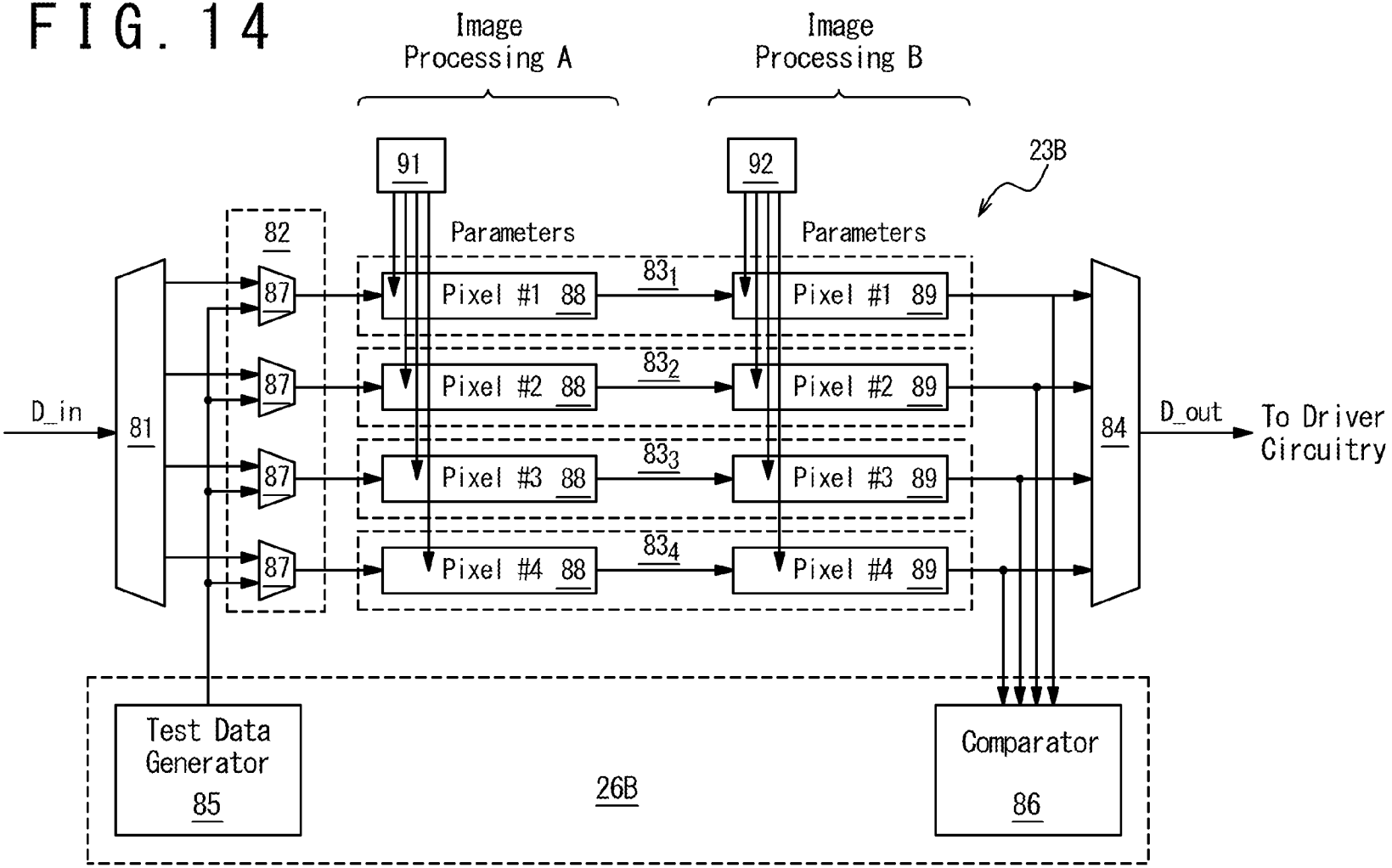
FIG. 14 illustrates example configurations of image processing circuitry and test circuitry, according to one or more embodiments.

FIG. 14 illustrates example configurations of image processing circuitry and test circuitry, denoted by numerals 23B and 26B, respectively, according to other embodiments. In one or more embodiments, the image processing circuitry 23B is configured to process image data D_in for a plurality of pixels in parallel. In the illustrated embodiment, the image processing circuitry 23B comprises parallelizer circuitry 81, selector circuitry 82, a plurality of pixel pipes 83, serializer circuitry 84, and parameter registers 91 and 92, where the pixel pipes 83 are configured to perform the same image processing. In the illustrated embodiment, the number of the pixel pipes 83 is four to allow the image processing circuitry 23B to process image data D_in for four pixels in parallel, but not limited to this. In other embodiments, the number of the pixel pipes 83 may be two, three, five or more.

The parallelizer circuitry 81 is configured to parallelize image data D_in to provide the parallelized image data to the pixel pipes 83, respectively. The selector circuitry 82 is configured to select the parallelized image data and test data received from the test circuitry 26B and provide the selected data to the pixel pipes 83. The selector circuitry 82 is configured to deliver the same test data to the respective pixel pipes 83 when selecting the test data. In the illustrated embodiment, the selector circuitry 82 comprises four selectors 87 each configured to select the corresponding parallelized image data and the test data and provide the selected data to the corresponding pixel pipe 83.

The pixel pipes 83 are each configured to process the corresponding parallelized image data to generate processed image data. In the illustrated embodiment, the pixel pipes 83 are adapted to two types of image processing A and image processing B. In other embodiments, the pixel pipes 83 may be each configured to perform three or more types of image processing or perform one type of image processing. Each pixel pipe 83 may include an image processing component 88 configured to perform image processing A and an image processing component 89 configured to perform image processing B. The image processing components 88 of the respective pixel pipes 83 are configured to receive the same parameters from the parameter register 91. This allows the image processing components 88 to perform the same image processing. Similarly, the image processing components 89 of the respective pixel pipes 83 are configured to receive the same parameters from the parameter register 92. The image processing performed by each pixel pipe 83 may include subpixel rendering, color adjustment, image scaling, gamma transformation, and/or other types of image processing. The serializer circuitry 84 is configured to serialize the processed image data received from the pixel pipes 83 to generate the output data D_out to be provided to the driver circuitry 24.

The test circuitry 26B includes test data generator circuitry 85 and comparator circuitry 86. The test data generator circuitry 85 is configured to generate the test data to be supplied to the pixel pipes 83. The comparator circuitry 86 is configured to compare the outputs of the pixel pipes 83. The test circuitry 26B is configured to detect a failure of the image processing circuitry 23B based on the comparison of the outputs of the pixel pipes 83.

In one or more embodiments, the image processing circuitry 23B is tested as follows. The test data generator circuitry 85 generates test data, and the selector circuitry 82 delivers the test data to the pixel pipes 83. The pixel pipes 83 receive the same test data and process the test data. The test circuitry 26B detects a failure of the image processing circuitry 23B based on comparison of the outputs of the pixel pipes 83. In some embodiments, the test circuitry 26B may detect a failure of the image processing circuitry 23B in response to one of the outputs from the pixel pipes 83 being different from a remaining one or more of the outputs from the plurality of pixel pipes 83. For example, the test circuitry 26B may determine that there is a failure in the image processing circuitry 23B when one of the outputs from the pixel pipes 83 is different from a different one of the outputs from the pixel pipes 83. In other embodiments, the test circuitry 26B may determine that there is no failure in the image processing circuitry 23B when the outputs from the pixel pipes 83 are the same.

Figure 15:
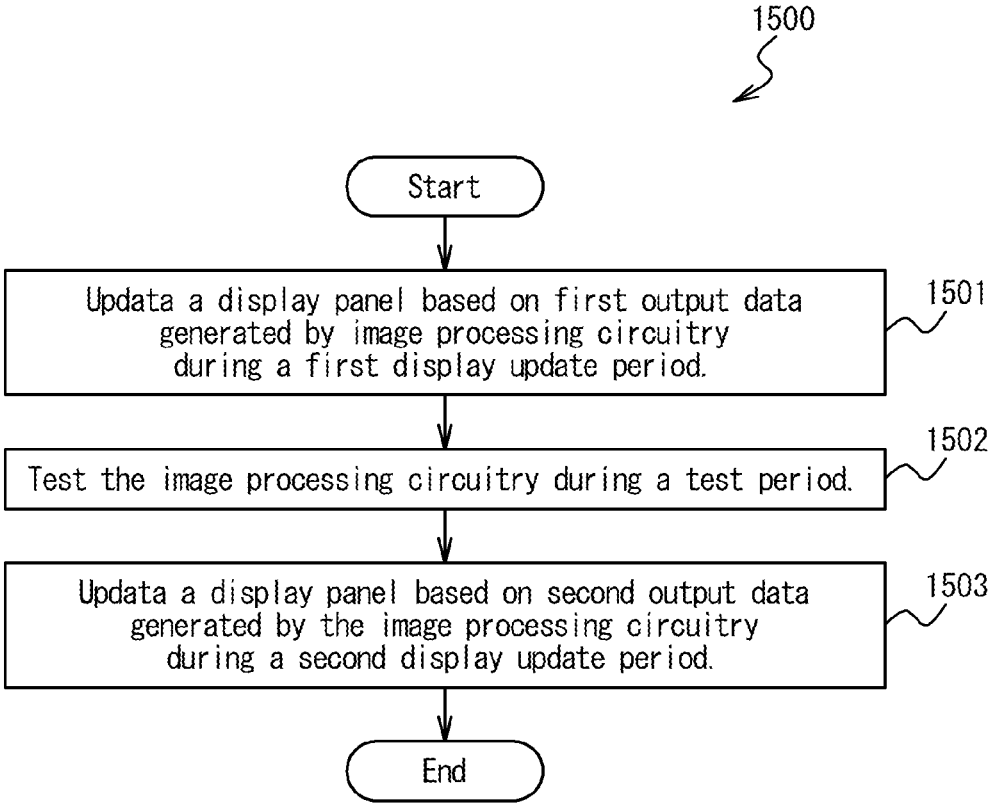
FIG. 15 illustrates an example method for controlling a display panel, according to one or more embodiments.

Method 1500 of FIG. 15 illustrates steps for controlling a display panel (e.g., the display panel 10 illustrated in FIG. 1), according to one or more embodiments. It should be noted that the order of the steps may be altered from the order illustrated.

At step 1501, the display panel is updated based on first output data generated by image processing circuitry (e.g., the image processing circuitry 23, 23A, and 23B illustrated in FIGS. 1, 3, 5A to 10D, and 14) during a first display update period (e.g., the display update periods $\mathbf{201}_1$, $\mathbf{201}_2$ illustrated in FIG. 2 and the display update periods $\mathbf{401}_1$ to $\mathbf{401}_4$ illustrated in FIG. 4). At step 1502, the image processing circuitry is then tested during a test period (e.g., the test periods $\mathbf{202}_1$ and $\mathbf{202}_2$ illustrated in FIG. 2 and the test periods $\mathbf{402}_1$ to $\mathbf{402}_4$ illustrated in FIG. 4). At step $\mathbf{150}_3$, the display panel is updated based on second output data generated by image processing circuitry during a second display update period (e.g., the display update periods $\mathbf{201}_2$, $\mathbf{201}_3$ illustrated in FIG. 2 and the display update periods $\mathbf{401}_2$ to $\mathbf{401}_5$ illustrated in FIG. 4). The test period is disposed between the first display update period and the second display update period.

While many embodiments have been described, those skilled in the art, having benefit of this disclosure, will appreciate that other embodiments can be devised which do not depart from the scope. Accordingly, the scope of the invention should be limited only by the attached claims.

What is claimed is:

1. A display driver, comprising:
image processing circuitry configured to:
generate first output data during a first display update period, and
generate second output data during a second display update period, wherein the
image processing circuitry comprises:
storage circuitry, and
a first image processing component configured to:
generate intermediate data used to generate the first output data during the first display update period,
store the intermediate data in the storage circuitry before a test period,
acquire the intermediate data from the storage circuitry after the test period, and
use the intermediate data to generate the second output data during the second display update period,
driver circuitry configured to:
update a display panel based on the first output data during the first display update period, and
update the display panel based on the second output data during the second display update period; and
test circuitry configured to test the image processing circuitry during the test period disposed between the first display update period and the second display update period.

2. The display driver of claim 1, wherein the image processing circuitry comprises a plurality of image processing components,
wherein the image processing circuitry is configured to bypass the first image processing component of the plurality of image processing components to generate third output data in response to the test circuitry detecting a failure of the first image processing component.

3. The display driver of claim 1, wherein the first image processing component is configured used to generate the first output data and the second output data, and
wherein the image processing circuitry further comprises:
a second image processing component configured to generate third output data in place of the first image processing component in response to the test circuitry detecting a failure of the first image processing component, and
wherein the driver circuitry is further configured to update the display panel based on the third output data.

4. The display driver of claim 3, wherein the first image processing component and the second image processing component are both configured to perform a gamma transformation.

5. A display driver comprising:
image processing circuitry configured to:
generate first output data during a first display update period, and
generate second output data during a second display update period,
wherein the image processing circuitry comprises:
a scan chain comprising a scan flipflop;
a data save flipflop configured to:
receive and store first data from the scan flipflop, and
restore the first data to the scan flipflop,
driver circuitry configured to:
update a display panel based on the first output data during the first display update period, and
update the display panel based on the second output data during the second display update period; and
test circuitry configured to test the image processing circuitry during a test period disposed between the first display update period and the second display update period.

6. The display driver of claim 5, wherein the data save flipflop is configured to:
receive the first data from the scan flipflop at an end of the first display update period; and
restore the first data to the scan flipflop after testing the image processing circuitry.

7. The display driver claim 1,
wherein the image processing circuitry comprises a plurality of pixel pipes configured to perform a same image processing on a same test data in parallel, and
wherein testing the image processing circuitry is based on comparison of outputs from the plurality of pixel pipes.

8. The display driver of claim 7, wherein the image processing circuitry is further configured to deliver the same test data to the plurality of pixel pipes in the testing of the image processing circuitry.

9. The display driver of claim 8, wherein testing the image processing circuitry comprises detecting a failure of the image processing circuitry in response to one of the outputs from the plurality of pixel pipes being different from a remaining one or more of the outputs from the plurality of pixel pipes.

10. The display driver of claim 8, wherein the test circuitry is further configured to generate the test data.

11. The display driver of claim 1, further comprising:

proximity sensing circuitry configured to:

acquire a resulting signal from a sensor element disposed in a sensing region during a proximity sensing period that at least partially overlaps the test period; and detect an input object in the sensing region based on the resulting signal.

12. The display driver of claim 1, wherein the test circuitry is configured to notify a host of a detection of a failure of the image processing circuitry, the host being external to the display driver.

13. A display system, comprising:

a display panel; and a display driver comprising:

image processing circuitry configured to:

generate first output data during a first display update period, and generate second output data during a second display update period, wherein the image processing circuitry comprises:

a scan chain comprising a scan flipflop, and a data save flipflop configured to:

receive and store first data from the scan flipflop, and restore the first data to the scan flipflop, driver circuitry configured to:

update the display panel based on the first output data during the first display update period, and update the display panel based on the second output data during the second display update period; and test circuitry configured to test the image processing circuitry during a test period disposed between the first display update period and the second display update period.

14. The display system of claim 13, wherein the image processing circuitry comprises a plurality of pixel pipes configured to perform same image processing in parallel, wherein testing the image processing circuitry is based on comparison of outputs from the plurality of pixel pipes.

15. The display system of claim 13, further comprising a host external to the display driver, wherein the test circuitry is configured to generate a failure notification to notify the host of a detection of a failure of the image processing circuitry.

16. The display system of claim 15, wherein the host is configured to output an alert indicating the detection of the failure from an output device in response to the failure notification.

17. The display system of claim 16, wherein the host is configured to supply image data corresponding to an alert image to the display driver in response to the failure notification, and wherein the display driver is configured to display the alert image.

* * * * *